US005981411A

United States Patent [19]

Brown

[11] Patent Number: 5,981,411

[45] Date of Patent: Nov. 9, 1999

[54] THERMOFORMABLE MATERIAL

[75] Inventor: Steven R. Brown, East Hampstead, N.H.

[73] Assignee: Foss Manufacturing Co., Inc., Hampton, N.H.

[21] Appl. No.: 09/078,975

[22] Filed: May 14, 1998

[51] Int. Cl.[6] ..... D02G 3/00

[52] U.S. Cl. ..... 442/364; 442/361; 442/362; 428/373; 428/374

[58] Field of Search ..... 428/373, 374; 442/361, 362, 364

[56] References Cited

U.S. PATENT DOCUMENTS 3,616,183 10/1971 Brayford ..... 428/373

*Primary Examiner*—Richard Weisberger
*Attorney, Agent, or Firm*—Perkins, Smith & Cohen; Jerry Cohen

[57] ABSTRACT

A thermoformable sheet material as made by use of homogeneously dispersed bicomponent fibers of polyester (12, 12A) and lower melting co-polyester (14, 14A) that are formed as a felt, heated to melt the lower melting component and resolidification of the melted fibers as blobs locking in cross over points of the polyester fibers and deifying and strengthening the felt as a whole into an enhanced thermoformable materials, with adhesives optionally applied to one or both surfaces thereof.

8 Claims, 1 Drawing Sheet

THERMOFORMABLE MATERIAL

BACKGROUND AND FIELD OF THE INVENTION

The present invention relates to thermoformable sheet materials usable in manufacture of shoe and skate braces, counters and box toes; vehicle headliners, rear decks and trunk compartments; and other like complex shaped parts with a significant strength specification, including such sheet materials with or without an applied, adhesive on one or both surfaces thereof, for laminating to other materials (e.g. shoe counters or box toe laminated to the shoe upper).

Materials of this general class have been made for the last fifty years. The current state of the art includes a segment of higher stiffness and low cost occupied by nonwoven fabrics saturated with polystyrene (i.e. saturated with a latex containing styrene that is dried to form a polystyrene matrix)[1] and another segment occupied by laminates of extruded resin and nonwoven fabric and hybrids, e.g. where a fabric, laminated to a resin, is saturated with polystyrene.

1 Other synthetic or cellulosic materials are also employed in such applications.

It is also known in connection with materials usable in carpets, headliners and trunks to densify and self bond all or portions of a nonwoven fiber mass by use of mixed higher and lower melting point fibers and heating between the two melting points so that the lower melting point fiber softens and rehardens as dispersed consolidated masses that lock in many crossover points of the higher melting fiber.

It is an object of the present invention to provide a thermoformable sheet form material of enhanced flexibility and resilience compared to the state of the art saturated fabric and resin laminate materials while affording the stiffness and strength of such state of the art materials.

It is a further object of the invention to provide a material that affords reliable, easily achieved design properties and is produceable at high rates and low cost, consistent with the foregoing objects.

It is a further object of the invention to provide an environmentally preferred material consistent with the foregoing objects.

Other objects, features and advantages will be apparent from the following detailed description of preferred embodiments taken in conjunction with the accompanying drawings in which:

DETAILED DESCRIPTION OF THE PREFERRED EMBODIMENTS

Figure 1:
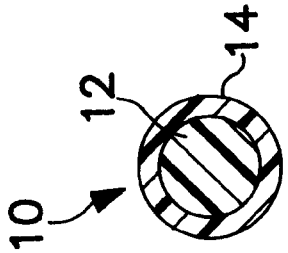
FIGS. 1, 1A and 1B are cross section sketches of two forms of starting fiber material used in making the thermoformable sheet material.
Figure 1A:
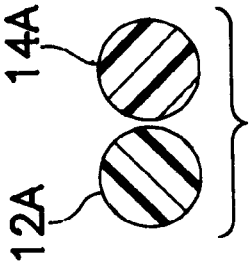
Figure 1B:
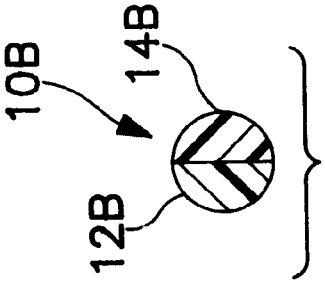

FIG. 1 shows a bicomponent fiber material 10 with a polyester core 12 and co-polyester sheath 14 and FIG. 1A shows side by side (typically interspersed with high consistency rather than literally side by side for full fiber lengths) single component fibers 12A and 14A of polyester and co-polyester, respectively. FIG. 1B shows a bicomponent fiber 10B with side by side component sections 12B, 14B of polyester and copolyester. More than two such sections can be provided on a fiber. In any version each of the polyester and co-polyester components are provided in 40–60 weight percentage proportions. Fibers are supplied as 4–20 denier with a cut length of 1–4 inches preferrably 1.5–3 and with 2–20 average of crimps per inch, preferrably 6–15.

Figure 2:
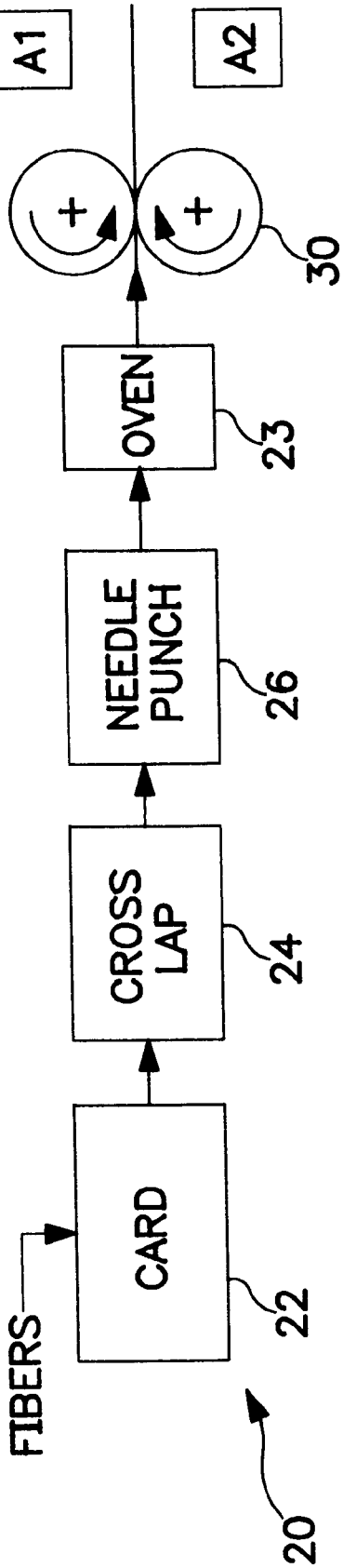
FIG. 2 is a block diagram of the manufacturing process/equipment.

FIG. 2 shows schematically the equipment/process 20 for making sheet materials from the fibers, including a carding machine 22 a cross-lapper 24 which applies the carded fiber in cross-lapped web fashion to a floor apron (not shown) that delivers the web to a needle punching apparatus 26 which needles the web form by use of needle arrays punched in one or both sides (preferrably the latter) of the web to produce a densified needled felt of mechanically interlocked fibers with a density of 0.04 to 1.0 ounces per cubic inch, preferrably 0.06 to 0.08.

The felt is fed through an oven 28 which heats the felt to a level exceeding the melt temperature of the co-polyester component. Typical oven exposures are ones that cause the needled felt to reach 150° C. and hold at that temperature for 30 seconds, 175° C. for 25 seconds or 150° for 20 seconds. The felt comes out of the oven and is immediately passed between chilled rolls that accomplish most of the resolidification of the co-polyester and fusing to adjacent polyester (rather than relying on slow ambient air cooling for this purpose). The nip between the rolls is typically 0.020–060 inches (about 20–30% of the nominal thickness of the felt emerging from the oven) and designed in relation to the felt's physical and chemical structure to densify the felt to about 0.15–0.40 ounces per cubic inch, preferrably 0.2–0.3.

The sheet material so formed has essentially pile-free, smooth upper and lower surfaces, optional but advantageous for many aesthetic and functional purposes.

Optionally a hot melt adhesive or other functional or decorative laminate or coating can be applied to either or both sides of the sheet by applicators A1, A2.

Typical applications of hot melt adhesive are: (a) 60–90 grams per square meter of a surface of about 400–800 grams per square meter base material, with a typical resultant final gauge of base material, with adhesive on two sides, of 1 mm; (b) 65/600/1.4 mm; (c) 65/800/1.8 mm. The hot melts are typically ethyl vinyl acetate, low melting polyethylene terephthalalate, acrylics and other well known choices.

The product is put in roll form or cut sheets for transportation or storage.

It can be seen in the longitudinal sections that the fiber to fiber bonds run along considerable length portions rather than just at cross-overs of higher melting fibers and that the mass is essentially a fiber reinforced matrix composite resembling the appearance of saturated fabrics.

Thermoforming of the material was carried out under typical shoe industry conditions and the formed products with results as follows:

Forming conditions: 275–325° F. for 20–30 seconds.

Test conditions: Samples are formed as counters and box toes using chilled counter/toe forming tools.

Results: 50% of greater resiliency as measured per SATRA Footwear Technology Center Test Method PM83.

These results of the present thermoformed product are compared to thermoformed state of the art styrene saturated non-wovens in Table 1.

TABLE 1

| Physical Property | Present Product 400/600/800 thick | Saturated Counter |
|---|---|---|
| initial collapse | 4/9/15 Kg* | 3–12 Kg** |
| 10th collapse | 3/6/10 Kg* | 3–10 Kg** |
| % resiliency | 65/65/65%* | 45–60%** |

*minimum figures
**averages for competitive weight/gauge

The material was also tested pre-thermoforming and compared to state of the art styrene saturated non-wovens and the results are shown in Table 2.

TABLE 2

| Physical Property | Present Product | Saturated Counters |
|---|---|---|
| Wt | 12/18/24 oz. | 21/24/27 oz. |
| gague | .040/.055/.071" | .040/.060/.080" |
| densify | .23/.26/.26 oz. | .41/.31/.26 oz/in. |

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

I claim:

1. A sheet form thermoformable composite material comprising homogeneously inter-dispersed polyester and copolyester plastic materials in approximately equal portions by weight (40–60 to 60–40) formed as a needled felt, with melting and resolidification of the co-polyester component and compression to an ultimate form of the polyester in a matrix of the resolidified copolyester with a density of 0.2 to 0.3 oz. per cubic inch in a sheet form of thickness of 0.8–2 mm, this material being thermoformable and usable in repetitive flexing without cracking.

2. The material of claim 1 as formed by initial bi-component fibers with polyester and copolyester segments.

3. The material of claim 1 as formed by initial side by side polyester and copolyester non-component fibers.

4. The material of any of claims 1, 2 or 3 as formed with initial fibers having 6–15 crimps per inch.

5. The material of claim 1 with at least one adhesive surface.

6. The material of claim 5 with both surfaces rendered adhesive by overlays of hot melt adhesive.

7. The material of any of claims 1, 5 or 6 thermoformed as a box toe.

8. The material of any of claims 1, 5 or 6 thermoformed as a shoe counter.

* * * * *